US012044103B2

(12) United States Patent
Suleymanov et al.

(10) Patent No.: US 12,044,103 B2
(45) Date of Patent: Jul. 23, 2024

(54) SUBSURFACE SAFETY VALVES, ISOLATION TOOLS, AND METHODS OF COUPLING

(71) Applicant: Saudi Arabian Oil Company, Dhahran (SA)

(72) Inventors: Oktay Suleymanov, Dhahran (SA); Kamal Aghazada, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/064,530

(22) Filed: Dec. 12, 2022

(65) Prior Publication Data

US 2024/0191598 A1 Jun. 13, 2024

(51) Int. Cl.
*E21B 34/10* (2006.01)

(52) U.S. Cl.
CPC ..... *E21B 34/107* (2013.01); *E21B 2200/05* (2020.05)

(58) Field of Classification Search
CPC ..... E21B 34/107; E21B 2200/05
See application file for complete search history.

(56) References Cited

U.S. PATENT DOCUMENTS 2,751,021 A * 6/1956 Muse ..... E21B 21/10 137/68.17
7,373,983 B2 5/2008 McGavern, III et al.
7,543,651 B2 6/2009 Smith
7,694,740 B2 4/2010 Mailand et al.
10,822,888 B2 11/2020 Sim
2004/0007365 A1* 1/2004 Hill, Jr. ..... E21B 34/102 166/323
2011/0147000 A1* 6/2011 Bolding ..... E21B 34/105 166/332.8

FOREIGN PATENT DOCUMENTS

GB 2567391 B 11/2021
WO 2021046223 A1 3/2021

* cited by examiner

*Primary Examiner* — James G Sayre
(74) *Attorney, Agent, or Firm* — DINSMORE & SHOHL LLP

(57) ABSTRACT

A subsurface safety valve includes an interior bore and a hinged valve actuatable between an open position and a closed position in which the hinged valve creates a fluid-tight seal with the interior bore. A latching mechanism secures an isolation tool within the interior bore of the valve. The isolation tool includes a tubular body having an exterior surface corresponding to the interior bore and an interior surface defining an internal bore. An annular groove is disposed on the exterior surface of the tubular body, and an annular seal is disposed in the annular groove. An equalization port is disposed downhole of the annular seal, and has one or more apertures for fluidly coupling an upper and lower portion of a wellbore. The subsurface safety valve further includes a control line for controlling the valve at a surface of the wellbore.

17 Claims, 5 Drawing Sheets

SUBSURFACE SAFETY VALVES, ISOLATION TOOLS, AND METHODS OF COUPLING

TECHNICAL FIELD

The present specification generally relates to isolation tools for drilling operations, and more specifically to isolation tools for subsurface safety valves.

BACKGROUND

Safety valves are commonly deployed in drilling operations as a means to shut-in a wellbore in the event the integrity of a surface wellhead is compromised during operation. However, current safety valves commonly experience a number of failures and malfunctions when engaged. For instance, some safety valves may fail to close as designed when hydraulic pressure within the wellbore is lost, which may lead to damage to the control line operating the safety valve or components of the valve itself (e.g., hinge pins, sealing surfaces, etc.). Over time, damage to the safety valve may result in uncommanded closure of the safety valve during production. Thus, a need exists for additional tools or methods capable of isolating and protecting components of safety valves.

SUMMARY

In one embodiment, a subsurface safety valve is disclosed. The subsurface safety valve may include an interior bore extending along an entire length of the subsurface safety valve. A hinged valve may be actuatable between an open position and a closed position, and may create a fluid-tight seal with the interior bore in the closed position. A latching mechanism may secure an isolation tool within the interior bore. The isolation tool may include a tubular body having an exterior surface shaped to correspond to the interior bore of the subsurface safety valve, and an interior surface defining an internal bore for use in a wellbore. An annular groove may be disposed on the exterior surface of the tubular body, and may be disposed fluidly downhole of the hinged valve of the subsurface safety valve when the isolation tool is secured within the interior bore of the subsurface safety valve. An annular seal may be further disposed in the annular groove. The subsurface safety valve may further include an equalization port disposed fluidly downhole of the annular seal of the isolation tool, and may have one or more apertures that fluidly couple an upper portion of the wellbore to a lower portion of the wellbore.

In another embodiment, an isolation tool is disclosed. The isolation tool may include a tubular body having an exterior surface shaped to correspond with an interior bore of the subsurface safety valve and an interior surface defining an internal bore. A latching mandrel may be position the isolation tool within the interior bore subsurface safety valve. The isolation tool may further include an annular groove disposed on the exterior surface, the annual groove being disposed fluidly downhole of a hinged valve of the subsurface safety valve. An annular seal may be further disposed on the annular groove. The isolation tool may also include an equalization port disposed fluidly downhole of the annular seal, the equalization port comprising one or more apertures fluidly coupling an upper portion of the wellbore to a lower portion of the wellbore.

In yet another embodiment, a method of coupling an isolation tool to a subsurface safety valve is disclosed. The method may involve positioning a subsurface safety valve having an interior bore into a wellbore, and coupling a slickline to a latching mandrel of the isolation tool. The method may further involve positioning the isolation tool within the interior bore of the subsurface safety valve in the wellbore, and securing the isolation tool to the subsurface safety valve by coupling the latching mandrel of the isolation tool to a latching mechanism of the subsurface safety valve. With the isolation tool coupled to the subsurface safety valve, the method may involve testing the integrity of the coupling between the isolation tool and the subsurface safety valve. Once the integrity of the coupling has been confirmed, the method may finally involve decoupling the slickline from the isolation tool; and removing the slickline from the wellbore.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
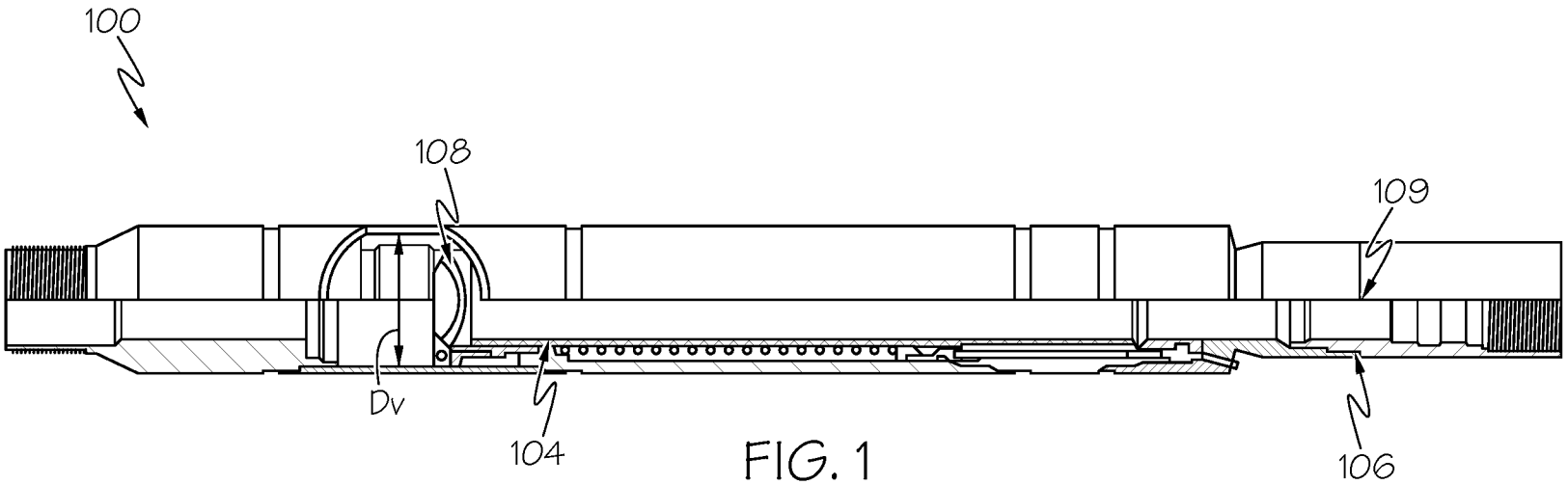
FIG. 1 depicts a cross-sectional schematic view of a subsurface safety valve, according to one or more embodiments shown and described herein.

Embodiments disclosed herein relate to subsurface safety valves, isolation tools, and methods of coupling isolation tools to subsurface safety valves. More specifically, the present disclosure includes an isolation tool for a safety valve having a body disposed within an interior bore of the safety valve for use in a wellbore.

As described in more detail herein, the isolation tool may include a tubular body having an exterior surface shaped to correspond with the interior bore of the safety valve and an interior surface defining an internal bore. A latching mandrel may be coupled to a slickline to position the isolation tool within the interior bore of the safety valve. An annular groove may be disposed on the exterior surface of the isolation tool, such that the annular groove is positioned fluidly downhole from a hinged valve of the isolation tool. An annular seal may be disposed in the annular groove, and an equalization port may be disposed fluidly downhole of the annular seal. In these embodiments, the equalization port may include one or more apertures fluidly coupling an upper portion of the isolation tool and a lower portion of the isolation tool.

As provided herein, the term "isolation tool" may generally refer to any tool that enables an operator of a wellbore to isolate a portion of the wellbore from hydrostatic and induced pressures.

As provided herein, the term "safety valve" may generally refer to a valve designed to automatically shut-in the flow of a wellbore in the event surface controls fail or surface equipment becomes damaged.

As provided herein, the term "subsurface safety valve" may refer to a safety valve which is includes a subsurface control mechanism designed to automatically close (e.g., actuated by the pressure differential/flow velocity across the safety valve) when a predetermined flow condition occurs in the wellbore.

As provided herein, the term "tubing-retrievable subsurface safety valve ('TRSSSV')" may refer to a type of subsurface safety valve that is run and retrieved as part of the production tubing string. The TTRSSV may enable internal components to be configured to provide wellbore access through the safety valve.

As provided herein, the term "slickline" may refer to a thin, nonelectric cable used for selective placement and retrieval of wellbore hardware, such as plugs, gauges, and valves located in mandrels.

As provided herein, the term "nipple" may refer to any short piece of pipe, and more particularly, to a piece of pipe threaded at both ends with male threads.

As discussed herein, many currently used subsurface safety valves present a number of reliability issues that often require substantial repairs throughout operation of the valve. For example, malfunctions with the subsurface safety valve may result in unprompted closing of the valve, which can crush or rupture the control lines used to operate the valve. Further still, the unprompted closure of the safety valve can cause leaks in the seals and/or junctions of the valve. When subsurface safety valves having pressure equalization mechanisms are employed, leaks within the seals and/or junctions of the valves may render the valves inoperable, as equalized pressure may be required to open the valve. Moreover, these malfunctions are not easily remedied, and often require removing the isolation tool from the wellbore entirely in order to repair. However, in accordance with an embodiment of the present invention, an isolation tool having a body may be coupled to an interior bore of the safety valve in order to effectively isolate the internal components of the safety valve. More particularly, the isolation tool may include a plurality of seals, the integrity of which may be verified by performing a negative pressure test to ensure that the internal components of the tool are effectively isolated. By isolating the components of the safety valve from the wellbore, the components may be protected from malfunctions occurring as a result of wellbore pressure, fluid, or improper use.

Embodiments of the isolation tool and methods of coupling an isolation tool to a subsurface safety valve will now be described in more detail herein. The following will now describe these tools and methods in more detail with reference to the drawings and where like numbers refer to like structures.

Figure 2:
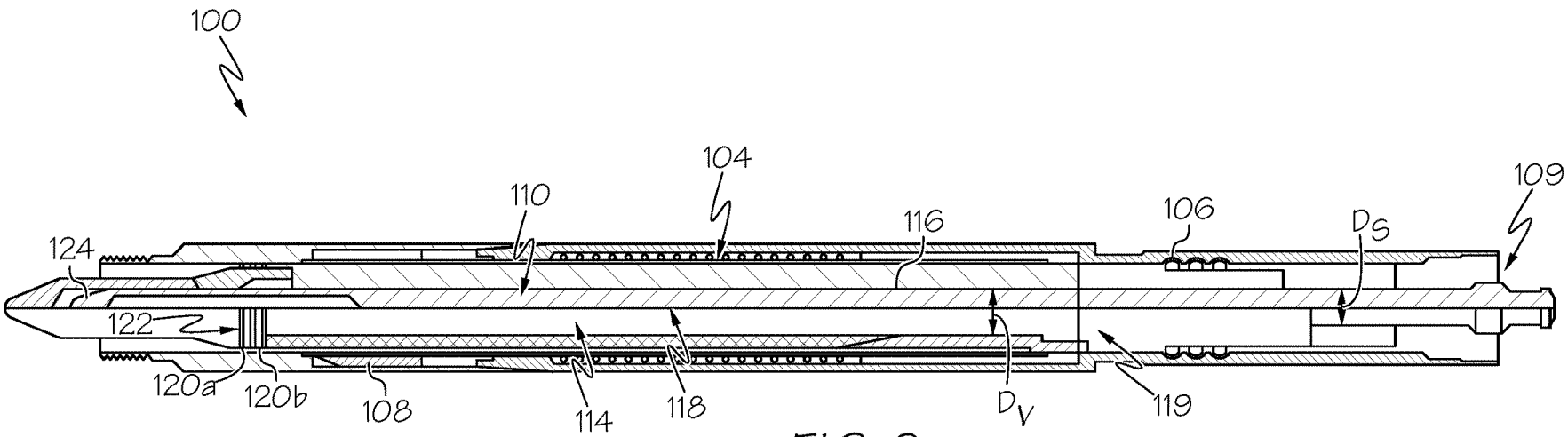
FIG. 2 depicts a cross-sectional schematic view of a subsurface safety valve coupled to an isolation tool, according to one or more embodiments shown and described herein.

Referring now to FIGS. 1 and 2, a subsurface safety valve 100, such as a TRSSSV, is depicted. The subsurface safety valve 100 may include an interior bore 104, which may extend along an entire length of the safety valve 100. In some embodiments, the interior bore 104 may have a diameter Dv that is sufficiently large to accommodate a slickline or other similar device, such that a wellbore may be accessible through the interior bore 104. The subsurface safety valve 100 may further include a latching mechanism 106, which may be used to couple an isolation tool 110 to the subsurface safety valve 100. In these embodiments, the latching mechanism may include a nipple, or any similar mechanism, which may be capable of withstanding typical wellbore axial loads.

Referring still to FIGS. 1 and 2, the subsurface safety valve 100 may be further equipped with a hinged valve 108, such as a flapper valve, which may be actuatable between an open position and a closed position using a control line 109. When adequate reservoir pressure is maintained within the subsurface safety valve 100, the hinged valve 108 may remain in the open position, such that the wellbore is accessible through the interior bore 104 of the subsurface safety valve 100. However, if the pressure within the subsurface safety valve 100 drops below a predetermined threshold (e.g., as occurs in the beginning stages of losing control of the wellbore), the hinged valve 108 may be actuated to the closed position. In these embodiments, "adequate reservoir pressure" may be determined by adding the reservoir pressure to the pressure supplied by the hinged valve 108 (e.g., via a spring or other similar mechanism) and subtracting the hydrostatic pressure of hydraulic fluid inside the control line 109.

When the hinged valve 108 is actuated to the closed position, the hinged valve 108 may fully obstruct the interior bore 104 of the subsurface safety valve 100. In these embodiments, the hinged valve 108 may create a fluid tight seal with the interior bore 104 in the closed position, such that fluids from the wellbore are incapable of flowing through the subsurface safety valve 100 and towards the surface of the wellbore.

Referring now to FIG. 2, the subsurface safety valve 100 is depicted with an isolation tool 110 installed within the interior bore 104 of the subsurface safety valve 100. In these embodiments, the isolation tool 110 may include a body 114 disposed within the interior bore 104 of the subsurface safety valve 100. The body 114, such as a tubular body, may include an exterior surface 116 and an interior surface 118. In these embodiments, the exterior surface 116 of the body 114 may be shaped to conform to the interior bore 104 of the subsurface safety valve 100. Thus, although the body 114 is depicted as being a tubular body, it should be understood that the body 114 may take any shape (e.g., rectangular, etc.) such that the exterior surface 116 corresponds to the shape of the interior bore 104.

As further depicted in FIG. 2, the body 114 may have a diameter Ds, which may be defined as the distance across the exterior surface 116 of the body. In these embodiments, the diameter of the body Ds may be smaller than the diameter Dv of the interior bore 104 of the subsurface safety valve 100, such that the body 114 of the isolation tool 110 may be installed within the interior bore 104 of the subsurface safety valve 100. In these embodiments, the isolation tool 110 may be installed in the subsurface safety valve 100 using a traditional slickline.

In operation, the isolation tool 110 may be installed in the subsurface safety valve 100 by attaching the isolation tool 110 to a slickline. Once the isolation tool 110 and the slickline are coupled, the slickline may be run into the subsurface safety valve 100. As the slickline and isolation tool 110 are lowered, the hinged valve 108 of the subsurface safety valve 100 may be opened by adjusting the pressure in the control line 109, as has been described herein. With the hinged valve 108 moved to the open position, the slickline and isolation tool 110 may be fully lowered into the interior bore 104 of the subsurface safety valve 100. Once the isolation tool 110 is appropriately positioned, the latching mechanism 106 may couple the isolation tool 110 to the subsurface safety valve 100, at which point the slickline may be withdrawn.

Referring still to FIG. 2, the interior surface 118 of the body 114 of the isolation tool 110 may define an internal bore 119. The internal bore 119 may extend along the entire length of the isolation tool 110, such that the wellbore may remain accessible through the internal bore 119 of the isolation tool 110 when the isolation tool 110 is installed within the subsurface safety valve 100. The internal bore 119 may be described in additional detail herein in reference to FIG. 3.

Figure 3:
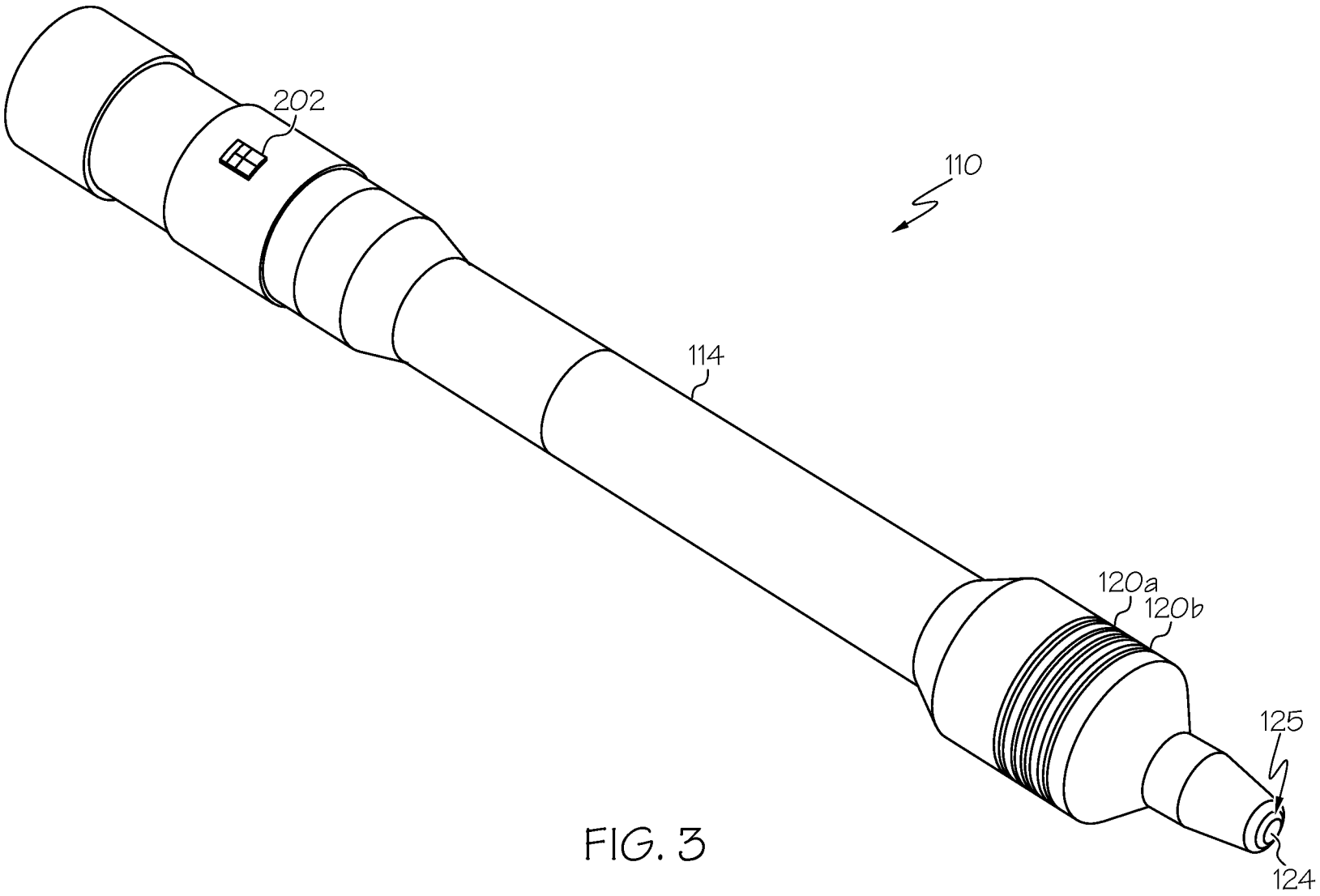
FIG. 3 depicts a perspective view of the isolation tool of FIG. 2, according to one or more embodiments shown and described herein.
Figure 4:
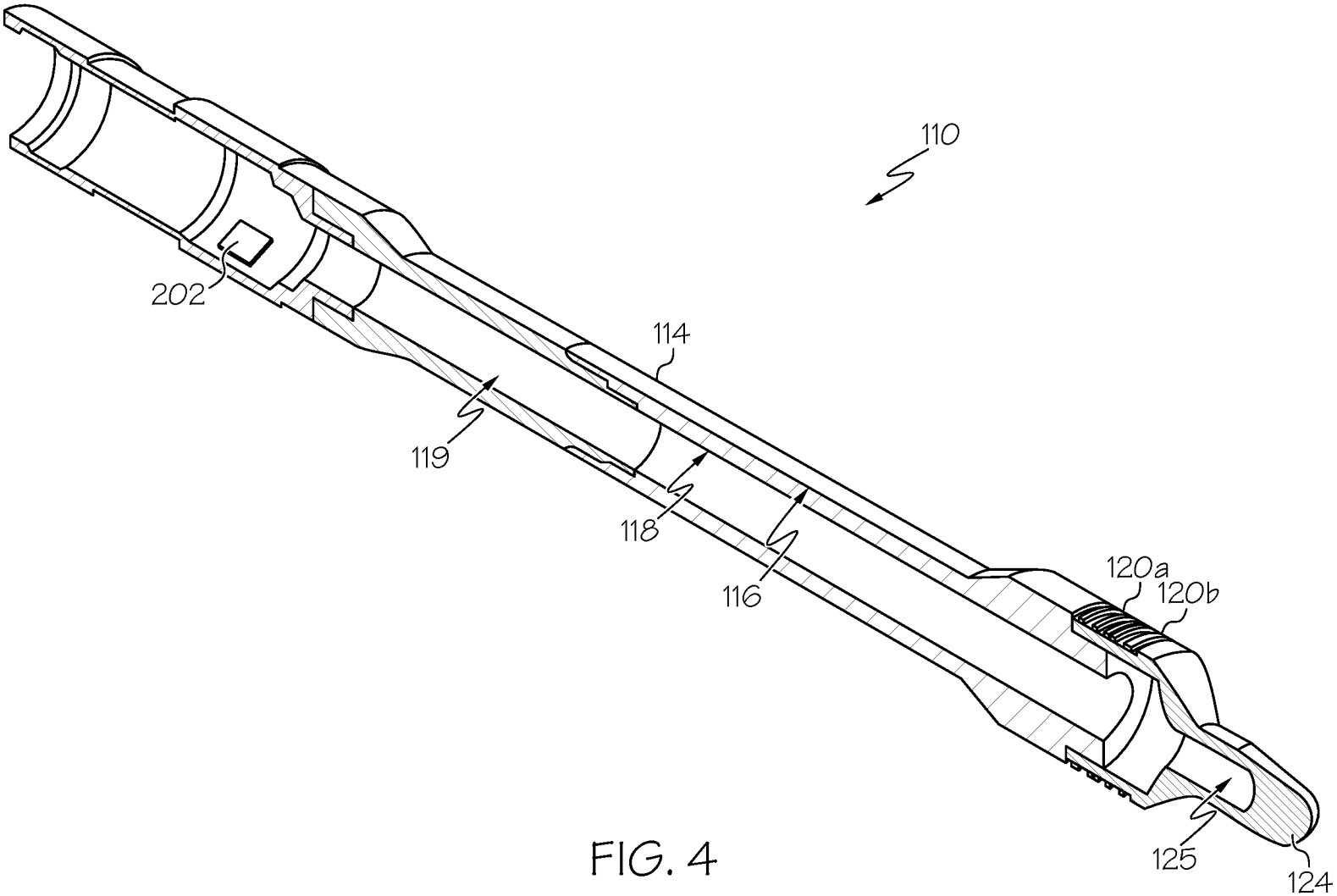
FIG. 4 depicts a cross-sectional view of the isolation tool of FIG. 3, according to one or more embodiments shown and described herein.

Referring now to FIGS. 2-3, the isolation tool 110 may further comprise an annular groove 120*a*, which, in some embodiments, may include a plurality of annular grooves 120*a*, 120*b*. As most clearly depicted in FIG. 3, the annular groove 120 may be disposed on the exterior surface 116 of the body 114. In some embodiments, the annular groove 120 may further include a plurality of annular grooves 120*a*, 120*b*, as is depicted in FIGS. 2 and 3.

The annular groove 120 may further include an annular seal 122 disposed in the annular groove 120*a*. In these embodiments, the annular seal 122 may be a chevron seal, or any other suitable seal. As defined herein, a chevron seal may be considered a seal having a male adaptor, a female adaptor and a group of vee rings. In these embodiments, the chevron seal may independently react to pressure to automatically affect a seal.

As most clearly depicted in FIG. 1, the annular grooves 120*a*, 120*b* and annular seal 122 may be disposed downhole (e.g., in the −x direction as depicted by the coordinate axis of FIG. 2) of the hinged valve 108 of the subsurface safety valve 100. By disposing the annular grooves 120*a*, 120*b* and annular seal 122 downhole of the hinged valve 108, a user may ensure that the internal components of the subsurface safety valve 100 positioned upstream (e.g., in the +x direction as depicted by the coordinate axis of FIG. 2) of the annular grooves 120*a*, 120*b* and the annular seal 122 are isolated from the wellbore in the event of a malfunction.

Furthermore, once the isolation tool 110 has been installed within the interior bore 104 of the subsurface safety valve 100, the annular seal 122 disposed within the annular groove 120 may be used to ensure that the coupling between the isolation tool 110 and the subsurface safety valve is of a desired integrity. More specifically, a negative test may be performed on the annular seal 122 to ensure that no leaks or other defects are present between the isolation tool 110 and the subsurface safety valve 100. Ensuring the integrity of the coupling between the isolation tool 110 and the subsurface safety valve 100 may serve to eliminate the risk of fluid communication between the wellbore fluid and the subsurface safety valve components (including the control line 109) during operation of the subsurface safety valve 100. Additionally, it should be understood that positioning of the isolation tool 110 within the subsurface safety valve 100 may allow the annular seal 122 to isolate the pressure from a bottom portion of the wellbore (e.g., below the annular seal 122, in the −x direction as depicted in the coordinate axis of FIG. 2) from an upper portion of the wellbore (e.g., above the annular seal, in the +x direction as depicted in the coordinate axis of FIG. 2).

In operation, the negative pressure test on the annular seal 122 may be performed by first pressurizing the wellbore to a predetermined reservoir pressure. With the wellbore pressurized, the isolation tool 110 may be installed within the subsurface safety valve 100, as has been described in detail herein. As the isolation tool 110 is positioned, wellbore pressure upstream of the annular seal 122 (e.g., in the +x direction as depicted in FIG. 2) may be bled off. With the wellbore pressure removed from an area above the annular seal 122, the negative pressure test may be conducted. In these embodiments, the negative pressure test may be conducted by monitoring the pressure of the area above the annular seal 122 for a predetermined time period. In the event that no pressure increase is observed above the annular seal 122 during the predetermined time period, a user may confirm that the annular seal 122 has effectively isolated the internal components of the subsurface safety valve 100 from the wellbore.

Referring now to FIGS. 1-4, the isolation tool 110 may further include an equalization mechanism 124. In these embodiments, the equalization mechanism 124 may be disposed fluidly downhole of the annular seal 122 (e.g., in the −x direction as depicted by the coordinate axis of FIG. 2).

The equalization mechanism 124 may further include at least one aperture 125 which may be in fluid communication with the internal bore 119 of the isolation tool 110. It should be understood that the at least one aperture 125 may further act to fluidly couple an upper portion of the wellbore (e.g., above the equalization mechanism 124, in the +x direction as depicted in the coordinate axis of FIG. 2) with a lower portion of the wellbore (e.g., below the equalization mechanism 124, in the −x direction as depicted in the coordinate axis of FIG. 2).

In operation, the fluid coupling of the upper portion of the wellbore and the lower portion of the wellbore via the equalization mechanism 124 may aid in operation of the hinged valve 108 of the subsurface safety valve 100. For example, when the hinged valve 108 is in the closed position, the hinged valve 108 may not be actuated to the open position via pressure from a lower portion of the wellbore. As a result, the pressure at the upper portion of the wellbore and the lower portion of the wellbore must be equalized in order to actuate the hinged valve 108. This may be accomplished by applying pressure from the surface into the upper portion of the wellbore, such that the equalization mechanism 124 may balance the pressure in the upper wellbore and lower wellbore. Once the pressure within the wellbore (and the subsurface safety valve 100) is equalized, the hinged valve 108 may be actuated to the open position. In the open position, the wellbore may be accessible from the surface through both the subsurface safety valve 100 and the isolation tool 110.

In some instances, reservoir pressure within the wellbore may cause the hinged valve 108 to move to the closed position prior to the isolation tool 110 being positioned within the subsurface safety valve 100. In these instances, the isolation tool 110 may be lowered into the body of the subsurface safety valve 100, such that the isolation tool 110 is positioned above the hinged valve 108 (e.g., in the +x direction relative to the hinged valve 108, as depicted in the coordinate axis of FIG. 2). The wellbore may then be pressurized (e.g., via pumps at the surface of the wellbore or other similar devices) until the pressure above the hinged valve 108 is equalized with the reservoir pressure within the wellbore (e.g., the pressure beneath the hinged valve 108, in the −x direction as depicted in the coordinate axis of FIG. 2). Once the pressure within the wellbore is equalized, the hinged valve 108 may be moved to the open position, such that the isolation tool 110 may be fully lowered into the subsurface safety valve 100.

Referring again to FIGS. 2-4, the isolation tool 110 may further include a latching mandrel 202, such as a lock mandrel. As defined herein, the term "lock mandrel" may refer to a downhole device that is run and retrieved on a slickline and is placed and anchored within a tubing string to provide a setting point for flow-control equipment, such as valves, chokes, and plugs.

As provided herein, the latching mandrel 202 may allow the isolation tool 110 to be run into the wellbore using a traditional slickline. As the isolation tool 110 is lowered into the subsurface safety valve 100, the latching mandrel 202 may be coupled to the latching mechanism 106 of the subsurface safety valve 100. With the latching mandrel 202 anchored to the latching mechanism 106 of the subsurface safety valve 100, the isolation tool 110 may be secured in position within the subsurface safety valve 100. At this point, the slickline may be disconnected from the latching mandrel 202 and withdrawn from the wellbore.

Figure 5:
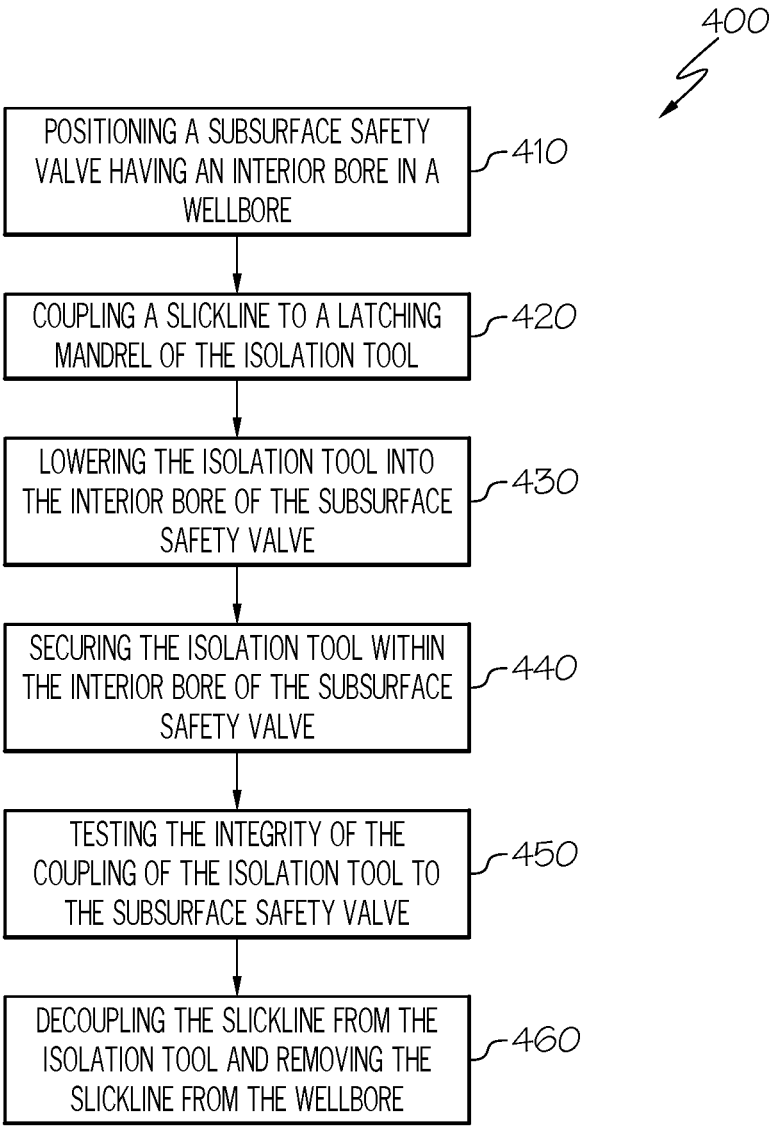
FIG. 5 depicts an illustrative flow diagram of a method of coupling an isolation tool to a subsurface safety valve, according to one or more embodiments shown and described herein.

Turning now to FIG. 5, an illustrative flow diagram of a method for coupling an isolation tool to a subsurface safety valve is described. As illustrated at block 410, the method may begin with positioning a subsurface safety valve having an interior bore into a wellbore. The subsurface safety valve may be positioned in the wellbore via a slickline or any other suitable means.

With the subsurface safety valve positioned in the wellbore, the method may proceed to block 420, which may involve coupling a slickline, or other suitable positioning mechanism, to a latching mandrel of the isolation tool. Once the slickline is coupled to the latching mandrel, the method may proceed to block 430, which may involve lowering the isolation tool into the interior bore of the subsurface safety valve.

As the isolation tool is lowered into the subsurface safety valve, the method may proceed to block 440, which may involve securing the isolation tool within the interior bore of the subsurface safety valve by coupling the latching mandrel of the isolation tool with a latching mechanism of the subsurface safety valve. It should be understood that, in some embodiments, the method may further include positioning the isolation tool within the interior bore of the subsurface safety valve such that an annular groove positioned on an exterior surface of the isolation tool is located fluidly downhole of a hinged valve of the subsurface safety valve.

With the isolation tool secured to the subsurface safety valve, the method may proceed to block 450, which may involve testing the integrity of the coupling between the isolation tool and the subsurface safety valve. In these embodiments, the step of testing the integrity of the coupling between the isolation tool and the subsurface safety valve may involve conducting a negative pressure test on an annular seal disposed on an annular groove of the isolation tool, as has been described in detail herein.

Once the integrity of the coupling has been confirmed, the method may move to block 460, which may involve decoupling the slickline from the isolation tool, such that the slickline may be removed from the wellbore. With the slickline withdrawn from the wellbore and the isolation tool coupled to the subsurface safety valve, wellbore operations may be commenced through the isolation tool and subsurface safety valve.

It should be understood that, in some embodiments, the method may optionally include equalizing pressure between an upper portion of the wellbore and a lower portion of the wellbore using an equalization mechanism disposed on the isolation tool fluidly downhole of the annular seal. In these embodiments, the pressure equalization between the upper portion of the wellbore and the lower portion of the wellbore may allow for actuation of the hinge valve between an open position and a closed position, as has been described in detail herein.

As should be appreciated in view of the foregoing, a subsurface safety valve, isolation tool, and method for coupling an isolation tool to a subsurface safety valve are described herein.

Embodiments may be further described with reference to the following numbered clauses:

1. A subsurface safety valve comprising: an interior bore extending along an entire length of the subsurface safety valve; a hinged valve actuatable between an open position and a closed position, wherein the hinged valve creates a fluid-tight seal with the interior bore in the closed position; a latching mechanism for securing an isolation tool within the interior bore, wherein the isolation tool comprises: a tubular body having an exterior surface shaped to correspond with the interior bore of the subsurface safety valve, and an interior surface defining an internal bore for use in a wellbore; an annular groove disposed on the exterior surface of the tubular body, the annular groove being disposed fluidly downhole of the hinged valve of the subsurface safety valve when the isolation tool is secured within the interior bore of the subsurface safety valve; an annular seal disposed in the annular groove; and an equalization port disposed fluidly downhole of the annular seal, the equalization port having one or more apertures fluidly coupling an upper portion of the wellbore to a lower portion of the wellbore; and a control line for controlling the subsurface safety valve at a surface of the wellbore.

2. The subsurface safety valve of item 1, wherein the hinged valve is able to fully open when the isolation tool is installed in the subsurface safety valve.

3. The subsurface safety valve of item 1, wherein the isolation tool is installed in the wellbore via a slickline.

4. The isolation tool of item 1, wherein the isolation tool further comprises a latching mandrel for coupling to the latching mechanism of the subsurface safety valve.

5. The subsurface safety valve of item 1, wherein the isolation tool fluidly isolates the interior bore of the subsurface safety valve and the control line from fluid in the wellbore.

6. The subsurface safety valve of item 1, wherein the annular seal is used to perform a negative pressure test on the isolation tool to verify that the isolation tool is secured to the subsurface safety valve.

7. The subsurface safety valve of item 1, wherein the annular seal is a chevron seal.

8. The subsurface safety valve of item 1, wherein the annular seal isolates the lower portion of the wellbore from the upper portion of the wellbore 9. An isolation tool for a subsurface safety valve, the isolation tool comprising: a tubular body having an exterior surface shaped to correspond with the interior bore of the subsurface safety valve and an interior surface defining an internal bore; a latching mandrel for positioning the isolation tool within the interior bore subsurface safety valve; an annular groove disposed on the exterior surface, the annual groove being disposed fluidly downhole of a hinged valve of the subsurface safety valve; and an annular seal disposed in the annular groove.

10. The isolation tool of item 1, wherein the latching mandrel is coupled to a slickline for positioning the isolation tool within the subsurface safety valve.

11. The isolation tool of item 1, wherein the annular seal is used to perform a negative pressure test on the isolation tool to verify that the isolation tool is secured to the subsurface safety valve.

12. The isolation tool of item 1, wherein the annular seal is a chevron seal.

13. The isolation tool of item 1, wherein the annular seal isolates the lower portion of the wellbore from the upper portion of the wellbore.

14. A method of coupling an isolation tool to a subsurface safety valve, the method comprising: positioning a subsurface safety valve having an interior bore into a wellbore; coupling a slickline to a latching mandrel of the isolation tool; positioning the isolation tool within the interior bore of the subsurface safety valve in the wellbore; securing the isolation tool to the subsurface safety valve by coupling the latching mandrel of the isolation tool to a latching mechanism of the subsurface safety valve; testing the integrity of the coupling between the isolation tool and the subsurface safety valve; decoupling the slickline from the isolation tool; and removing the slickline from the wellbore.

15. The method of item 14, wherein the method step of positioning the isolation tool within the interior bore of the subsurface safety valve further comprises positioning an annular groove disposed on an exterior surface of the isolation tool fluidly downhole of a hinged valve of the subsurface safety valve.

16. The method of item 14, wherein the method step of testing the integrity of the coupling between the isolation tool and the subsurface safety valve further comprises conducting a negative pressure test on an annular seal positioned on an exterior surface of the isolation tool.

17. The method of item 16, wherein conducting the negative pressure test comprises: pressurizing the wellbore to a predetermined reservoir pressure; removing pressure from an area upstream of the annular seal of the isolation tool; monitoring the pressure in the area upstream of the annular seal of the isolation tool for a predetermined time period; and confirming that the pressure in the area upstream of the annular seal of the isolation tool does not increase during the predetermined time period.

18. The method of item 17, further comprising repositioning the isolation tool within the subsurface safety valve if the pressure in the area upstream of the annular seal of the isolation tool increases during the predetermined time period.

19. The method of item 15, further comprising equalizing pressure between an upper portion of the wellbore and a lower portion of the wellbore using an equalization mechanism disposed on the isolation tool.

20. The method of item 18, wherein the method step of equalizing pressure between an upper portion of the wellbore and a lower portion of the wellbore comprises: alternating the hinged valve to a closed position; pressurizing an area upstream of the hinged valve until pressure upstream of the hinged valve equals a reservoir pressure of the wellbore; and alternating the hinged valve to the open position, such that the isolation tool may be positioned in the subsurface safety valve.

The terminology used herein is for the purpose of describing particular aspects only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. The term "or a combination thereof" means a combination including at least one of the foregoing elements.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A subsurface safety valve comprising:

an interior bore extending along an entire length of the subsurface safety valve;

a hinged valve actuatable between an open position and a closed position, wherein the hinged valve creates a fluid-tight seal with the interior bore in the closed position;

a latching mechanism for securing an isolation tool within the interior bore, wherein the isolation tool comprises:

a tubular body having an exterior surface shaped to correspond with the interior bore of the subsurface safety valve, and an interior surface defining an internal bore for use in a wellbore;

an annular groove disposed on the exterior surface of the tubular body, the annular groove being disposed fluidly downhole of the hinged valve of the subsurface safety valve when the isolation tool is secured within the interior bore of the subsurface safety valve; and an annular seal that is disposed in the annular groove and isolates the lower portion of the wellbore from the upper portion of the wellbore;

an equalization port disposed fluidly downhole of the annular seal, the equalization port having one or more apertures fluidly coupling an upper portion of the wellbore to a lower portion of the wellbore; and a control line for controlling the subsurface safety valve at a surface of the wellbore;

wherein the annular seal is used to perform a negative pressure test on the isolation tool to verify that the isolation tool is secured to the subsurface safety valve.

2. The subsurface safety valve of claim 1, wherein the hinged valve is able to fully open when the isolation tool is installed in the subsurface safety valve.

3. The subsurface safety valve of claim 1, wherein the isolation tool is installed in the wellbore via a slickline.

4. The isolation tool of claim 1, wherein the isolation tool further comprises a latching mandrel for coupling to the latching mechanism of the subsurface safety valve.

5. The subsurface safety valve of claim 1, wherein the isolation tool fluidly isolates the interior bore of the subsurface safety valve and the control line from fluid in the wellbore.

6. The subsurface safety valve of claim 1, wherein the annular seal is a chevron seal.

7. The isolation tool of claim 1, wherein the latching mandrel is coupled to a slickline for positioning the isolation tool within the subsurface safety valve.

8. The isolation tool of claim 1, wherein the annular seal is a chevron seal.

9. The isolation tool of claim 1, wherein the annular seal isolates the lower portion of the wellbore from the upper portion of the wellbore.

10. An isolation tool for a subsurface safety valve, the isolation tool comprising:

a tubular body having an exterior surface shaped to correspond with the interior bore of the subsurface safety valve and an interior surface defining an internal bore;

a latching mandrel for positioning the isolation tool within the interior bore subsurface safety valve;

an annular groove disposed on the exterior surface, the annual groove being disposed fluidly downhole of a hinged valve of the subsurface safety valve; and an annular seal that is disposed in the annular groove and isolates the lower portion of the wellbore from the upper portion of the wellbore;

wherein the annular seal is used to perform a negative pressure test on the isolation tool to verify that the isolation tool is secured to the subsurface safety valve.

11. A method of coupling an isolation tool to a subsurface safety valve, the method comprising:

positioning a subsurface safety valve having an interior bore into a wellbore;

coupling a slickline to a latching mandrel of the isolation tool;

positioning the isolation tool within the interior bore of the subsurface safety valve in the wellbore;

securing the isolation tool to the subsurface safety valve by coupling the latching mandrel of the isolation tool to a latching mechanism of the subsurface safety valve;

testing an integrity of the coupling between the isolation tool and the subsurface safety valve;

decoupling the slickline from the isolation tool; and removing the slickline from the wellbore.

12. The method of claim 11, wherein the method step of positioning the isolation tool within the interior bore of the subsurface safety valve further comprises positioning an annular groove disposed on an exterior surface of the isolation tool fluidly downhole of a hinged valve of the subsurface safety valve.

13. The method of claim 12, further comprising equalizing pressure between an upper portion of the wellbore and a lower portion of the wellbore using an equalization mechanism disposed on the isolation tool.

14. The method of claim 11, wherein the method step of testing the integrity of the coupling between the isolation tool and the subsurface safety valve further comprises conducting a negative pressure test on an annular seal positioned on an exterior surface of the isolation tool.

15. The method of claim 14, wherein conducting the negative pressure test comprises:

pressurizing the wellbore to a predetermined reservoir pressure;

removing pressure from an area upstream of the annular seal of the isolation tool;

monitoring the pressure in the area upstream of the annular seal of the isolation tool for a predetermined time period; and confirming that the pressure in the area upstream of the annular seal of the isolation tool does not increase during the predetermined time period.

16. The method of claim 15, further comprising repositioning the isolation tool within the subsurface safety valve if the pressure in the area upstream of the annular seal of the isolation tool increases during the predetermined time period.

17. The method of claim 16, wherein the method step of equalizing pressure between an upper portion of the wellbore and a lower portion of the wellbore comprises:

alternating the hinged valve to a closed position;

pressurizing an area upstream of the hinged valve until pressure upstream of the hinged valve equals a reservoir pressure of the wellbore; and alternating the hinged valve to the open position, such that the isolation tool may be positioned in the subsurface safety valve.

* * * * *